United States Patent [19]

Lawson

[11] Patent Number: 4,978,241

[45] Date of Patent: Dec. 18, 1990

[54] ROOF GUTTER MAINTENANCE AND CLEANING APPARATUS

[76] Inventor: Tony Lawson, 566 Commerce, Gretna, La. 70056

[21] Appl. No.: 502,751

[22] Filed: Apr. 2, 1990

[51] Int. Cl.[5] ..... B08B 9/00; A47L 25/00

[52] U.S. Cl. ..... 401/118; 134/167 C; 134/198; 15/236.04; 239/280; 239/532; 401/137

[58] Field of Search ..... 239/280, 532, 280.5, 239/281; 15/236.08, 92, 104.05, 236.04; 134/167 C, 168 C, 198; 401/137, 9–11, 15, 28, 48, 139, 268, 193–195, 261, 263, 265, 266

[56] References Cited

U.S. PATENT DOCUMENTS

| | | | |
|---|---|---|---|
| 2,710,616 | 6/1955 | Tydings | 134/167 R |
| 3,023,971 | 3/1962 | Milhous | 239/280 |
| 3,751,749 | 8/1973 | Wilson | 15/92 |
| 4,183,368 | 1/1980 | Husted | 134/198 |
| 4,238,866 | 12/1980 | Taylor | 56/12.7 |
| 4,319,851 | 3/1982 | Arthur | 401/137 |
| 4,349,039 | 9/1982 | Egger | 401/48 |

*Primary Examiner*—Richard J. Johnson
*Attorney, Agent, or Firm*—Keaty & Keaty

[57] ABSTRACT

The invention relates to a roof gutter cleaning device which enables a person to clean the roof gutter from a ground level. The cleaning apparatus has a stabilizing roller and a supporting roller. The supporting roller rolls along the bottom of the roof gutter, while the stabilizing roller rolls along the lip gutter, stabilizing movement of the cleaning apparatus. An elongated hollow handle delivers water or a treatment liquid to a spray nozzle which sprays the water or the treatment liquid in the gutter, further facilitating cleaning of the gutter.

11 Claims, 4 Drawing Sheets

ROOF GUTTER MAINTENANCE AND CLEANING APPARATUS

BACKGROUND OF THE INVENTION

The present invention relates to a roof gutter maintenance apparatus, and more specifically to an apparatus which enables a person to clean and maintain a roof gutter, while standing on the ground or at least a safe distance from the roof's edge.

As the gutters of a building become clogged with fallen leaves, dust and other debris, there exists a need for cleaning of the gutters to prevent heavy accumulation of such debris, which may lead to breaking of gutters and inability of the gutters to form a conduit for rain water in the regular manner. Additionally, accumulation of moist material and retention thereof in the gutters causes rusting and eventual deterioration of the gutters. To prevent such damage to the gutters, a person usually climbs to the roof of a building and cleans the gutters with a hand-held scraper or other similar tool, leaning dangerously to the edge of a building or climbs a ladder to the level of the gutter to clean it by a conventional cleaning tool.

However, both of these approaches are unsatisfactory should the building be more than one story high, in which case dangerous conditions exist for a serious injury to a person should he fall down from the roof or a ladder. Further, many homeowners find it physically impossible to clean the gutters by the above-noted two methods and have to call on professionals which leads to greater expenditures than the homeowner may wish to extend.

The present invention contemplates provision of a roof gutter cleaning apparatus which enables a person to clean and maintain the gutters while standing on the ground, without exposing himself to a danger of high elevation, or in the instance of a flat roof, enables the person to clean and maintain the gutters a safe distance from the roof's edge.

SUMMARY OF THE INVENTION

The present invention overcomes shortcomings of the prior art and achieves its objects in a simple and straight forward manner. A roof gutter maintenance apparatus is provided, which comprises an elongated hollow handle of a length sufficient for extending from the ground level to a roof gutter. Fixedly attached to a distant end of the handle is a supporting plate which carries a spraying nozzle on the top surface thereof. The spraying nozzle is in fluid communication with the hollow interior of the handle, so that the liquid traveling from the opposite end of the handle is propelled to the nozzle and sprayed into the roof gutter. The liquid can be water or treatment liquid, such as anti-corrosion solution, sealant and the like.

A first pair of brackets extend perpendicularly downward from the bottom surface of the supporting plate, with a pin passing through co-aligned apertures in the lower portions of the brackets. Supported on the pin, in a free rotational movement, is a first roller which supports the gutter maintenance apparatus while rolling along the bottom surface of the gutter. A second pair of brackets are mounted in laterally spaced-apart parallel relationship to the first pair of brackets and support a pin which passes through co-aligned apertures formed in the lower portions of the second pair of brackets. The second pin serves as a rotational axis for a second spool-like roller which stabilizes the position of the maintenance apparatus while rolling along a lip of a roof gutter, preventing lateral displacement of the cleaning apparatus during its movement along the roof gutter.

A pair of securing plates are angularly and fixedly attached on opposite sides of the supporting plate and are adapted for securing a roof gutter maintenance and cleaning attachment tool to alternative sides of the securing plate, depending on the direction of movement of the cleaning apparatus along a roof gutter. The cleaning attachment tool or device can be in the form of a rake, rubber "squeeze" device or other similar tool. The cleaning apparatus can be selectively moved along the gutter in the left-hand or right-hand directions, whichever is required.

It is therefore an object of the present invention to provide a roof gutter maintenance and cleaning apparatus which is stable in operation and is stable in movement along the roof gutter.

It is a further object of the present invention to provide a roof gutter maintenance apparatus which has means for delivery of water or a treatment liquid to the roof gutter from the ground level.

It is still a further object of the present invention to provide a maintenance apparatus which has means to allow changing of a cleaning attachment device, when required.

It is still another object of the present invention to provide a maintenance apparatus which has means for propelling of liquid from a ground level to a spray nozzle for spraying of a liquid at the level of a roof gutter.

These and other objects of the present invention will be more apparent to those skilled in the art from the following detailed description of the present invention.

BRIEF DESCRIPTION OF THE DRAWINGS

Reference will now be made to the drawings, wherein like parts are designated by like numerals.

DETAIL DESCRIPTION OF THE PREFERRED EMBODIMENT

Figure 1:
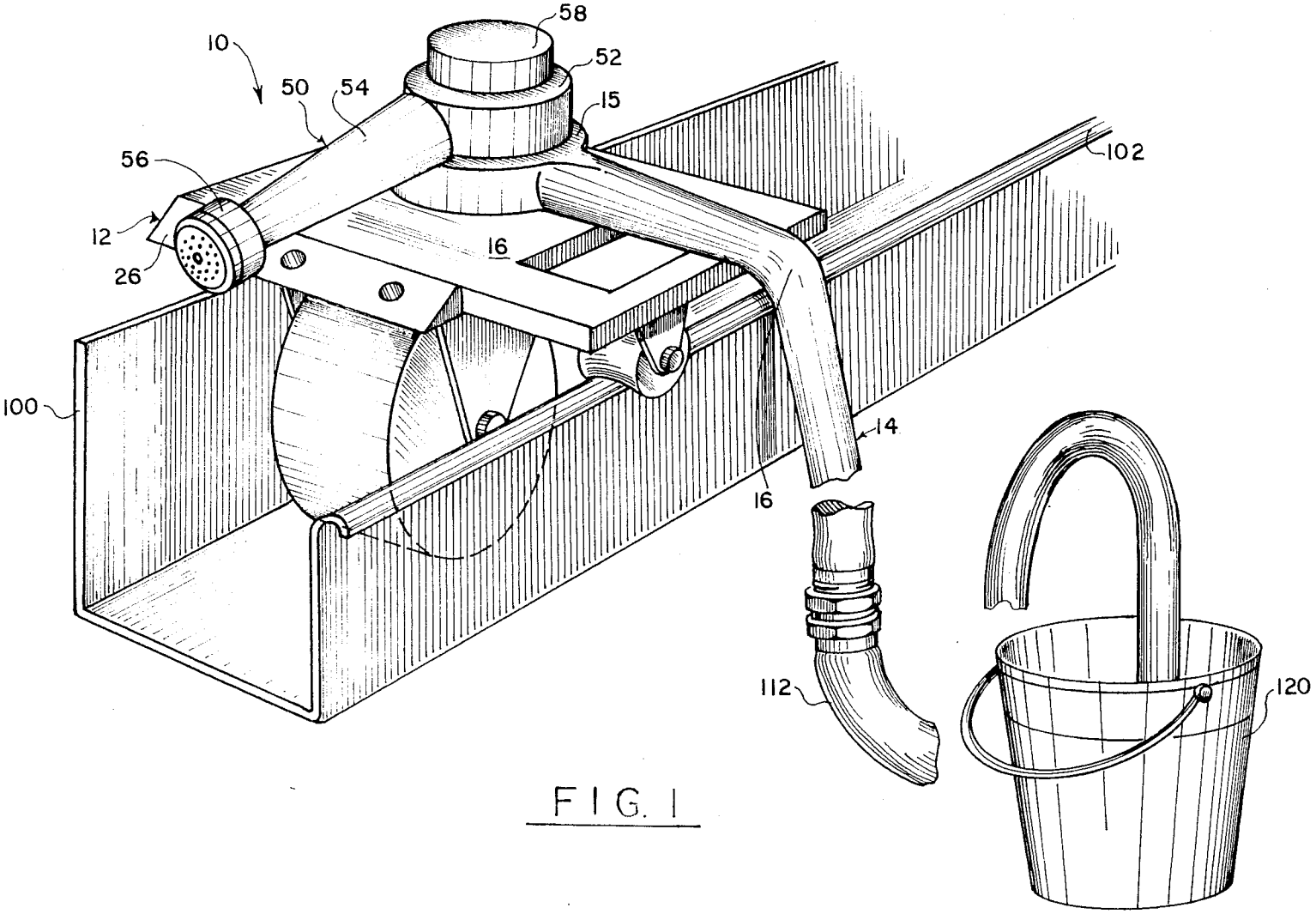
FIG. 1 is a perspective view of the roof gutter maintenance apparatus in accordance with the present invention.
Figure 3:
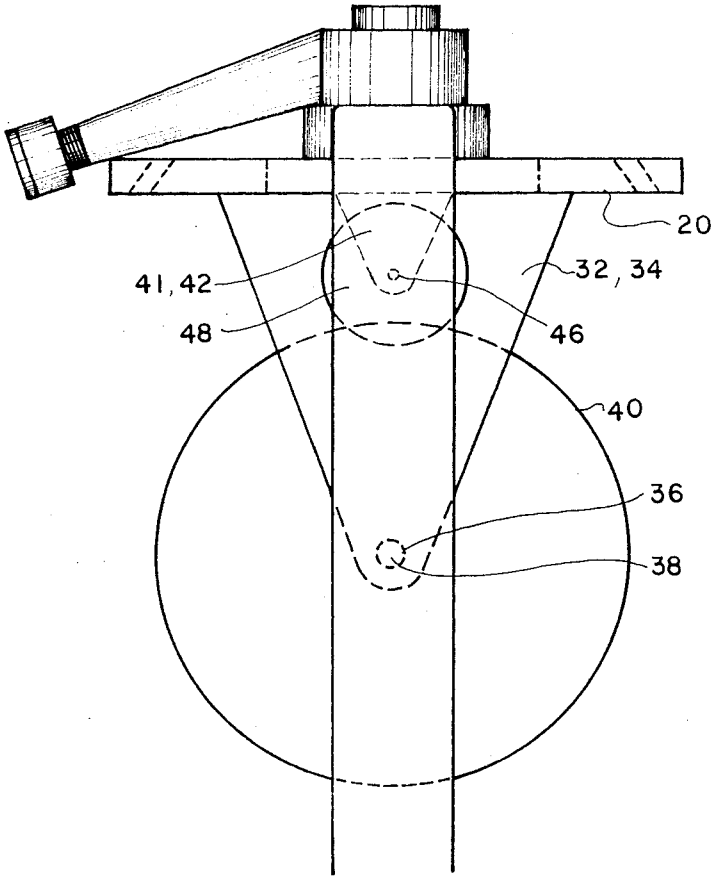
FIG. 3 is a right side view of the apparatus of the present invention.
Figure 2:
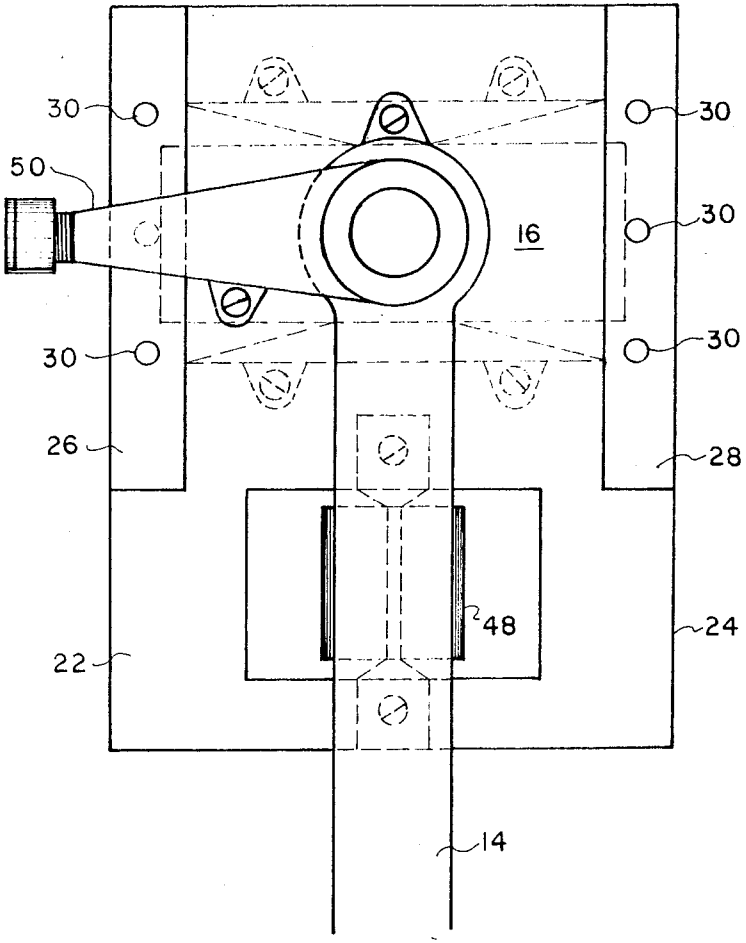
FIG. 2 is a top view of the apparatus of the present invention.

Reference will now be made to the drawings, wherein numeral 10 designates a roof gutter maintenance and cleaning apparatus of the present invention. The apparatus 10 comprises a supporting plate means 12 and a handle means 14 which is fixedly attached to the plate means 12 about a center of the supporting plate means 12 and extends along the longitudinal axis of the plate means 12 and bends as at 16 to extend downwardly at about a right angle to the lateral surface of the plate means 12 to a sufficient distance to allow handling of the apparatus 10 from the ground. The handle means 14 can be formed as an elongated pipe having a central conduit formed through the length thereof, or alternatively can be formed of a number of sections which can be easily connected to each other by threadable or telescopic engagement, if so desired.

The support plate means 12 has a generally rectangular configuration having a top surface 18 and bottom surface 20. Angularly attached to the sides 22 and 24 of the plate means 12 are a pair of securing plates 26 and 28, respectively. The plates 26 and 28 are fixedly attached, such as by welding to the supporting plate means 12 and are designed for securing of a cleaning attachment tool to the plate means 12. In order to facilitate the affixing of an attachment tool to the securing plates 26 and 28, a plurality of openings 30 are made in the plates 26 and 28 along the longitudinal axes thereof. The openings 30 are adapted to receive a bolt or a securing pin therethrough, so as to secure a cleaning attachment tool to the supporting plate means 12, as will be described in more detail hereinafter.

Extending substantially perpendicularly downwardly from the bottom surface 20 of the supporting plate means 12 are a pair of parallel spaced apart brackets 32 and 34, which are fixedly attached to the bottom surface 20 in a conventional manner (for example, by welding). The plates 32 and 34 are symmetrical and each have co-aligned openings 36 formed in the lowermost parts thereof. Passing through the openings 36 is a pin 38 which supports and carries a rotating wheel 40, which supports the apparatus 10 by contacting the bottom surface of a gutter 100. The wheel 40 freely rotates about the pin 38, allowing movement of the apparatus 10 in either direction along the bottom of the gutter 100.

Coaxially aligned along the longitudinal axis of the supporting plate means 12 is a pair of secondary supporting brackets 41 and 42 which are fixedly attached to the bottom 20 of the plate means 12 and extend downwardly therefrom to support a second roller 48, which freely rotates about a pin 46, with the ends of the pin extending through co-aligned respective openings formed in the lower parts of the brackets 41 and 42.

As can be seen in the drawings, the brackets 41 and 42 are smaller in size than the brackets 32 and 34, so that rotational axis of the second roller 48 is closer to the bottom surface 20 of the plate means 12 than the rotational axis of the wheel 40.

The roller 48 is spool-shaped, with a central portion having a smaller diameter than the end portions, which are adjacent to brackets 41 and 42. The roller 48 is adapted to roll along a lip 102 of the gutter 100, further stabilizing and aligning movement of the apparatus 10 along the gutter 100. Therefore, the length of the roller 48 is preferably equal or slightly greater than the width of the gutter lip 102.

As a result, the weight of the supporting plate means 12 and of any cleaning attachment securable to the securing plates 22 and 24 is easily distributed between the wheel 40 and the roller 48, thus providing increased stability and ease of movement to the apparatus 10.

The handle 14, as was described earlier, is made hollow, so as to allow liquid, such as water or sealant, or anti-corrosion solution to be delivered from a level below the gutter 100 to a nozzle means 50. To accomplish this task, a lowermost portion of the handle means 14 is formed with external threads onto which a water hose can be easily threaded, thus connecting the handle means 14 to a water supply. Should a deterioration in the gutter surface be suspected, it may be desirable to first clean the gutter, then deposit a sealing or anti-corrosion layer on the surface of the gutter 100, which is exposed to the environment. In order to accomplish this, a container 120 with a sealant or an anti-corrosion solution placed in close proximity to the work area. A flexible hose 122 or a lowermost end of the handle means 14 is lowered into the container 120.

Figure 7:
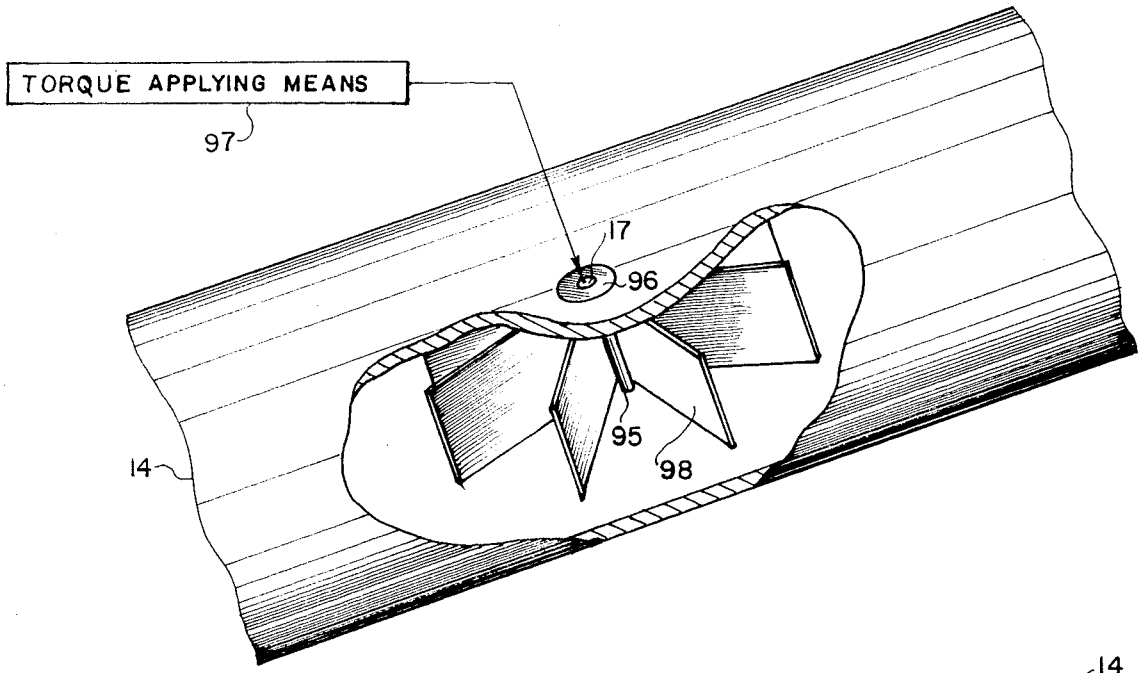
FIG. 7 is a cutaway view of the means for propelling a liquid along the interior of the handle.
Figure 8:
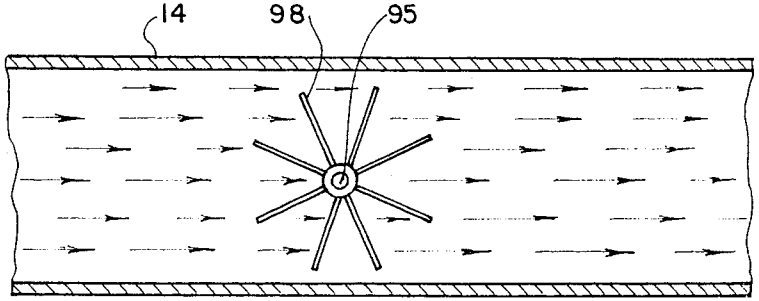
FIG. 8 is a cross sectional view, illustrating means for propelling a liquid along the interior of the handle.

Mounted inside the handle means 14 is a propeller means 92 which can be a paddle wheel 94 shown in FIGS. 7 and 8 or other similar device. The axle 95 of the wheel 94 is transverse to the longitudinal axis of the handle means 14. An opening 17 is formed in the wall of the handle 14 and a plug 96 is inserted therein. An open outer end of the plug 96 is sized and shaped to receive a rotating shaft (not show) of a torque applying means 97, which can be in the form of a standard electrical drill. The rotation applied through the rotating shaft to the plug 96, causing rotation of the axle 95 and, thus, rotation of radially extending plates 98. The liquid in the handle means 14 is forced to propell towards the spray nozzle 50, so that the sealant can be delivered through the hollow interior of the handle means 14 to the nozzle 50 and, from thereon, onto the surface of the roof gutter 100.

The nozzle means 50 is pivotally attached to the handle means 14 at the end portion thereof, with an attachment ring 52 of the nozzle means 50 being in coaxial alignment with an attachment ring 15 of the handle means 14.

Extending outwardly from the attachment ring 52 is a nozzle extension 54 which, at the outermost end thereof, is provided with a spray head 56 for delivering the liquid through a plurality of holes, to the exterior of the nozzle extension 54.

One or more washers 58 secure position of the nozzle means 50 on the handle means 14. The washers 58 seal the opening and reduce friction when the nozzle means 50 is rotated from one direction to another, depending on the movement of the apparatus 10 along the gutter 100. A locking means (not shown) allows locking of the nozzle means 50 in one of its two alternative positions, so that under the influence of the jet force of the delivered liquid the nozzle means retains its alignment, delivering the desired liquid into the gutter 100.

Figures 4, 5, 6, 9:
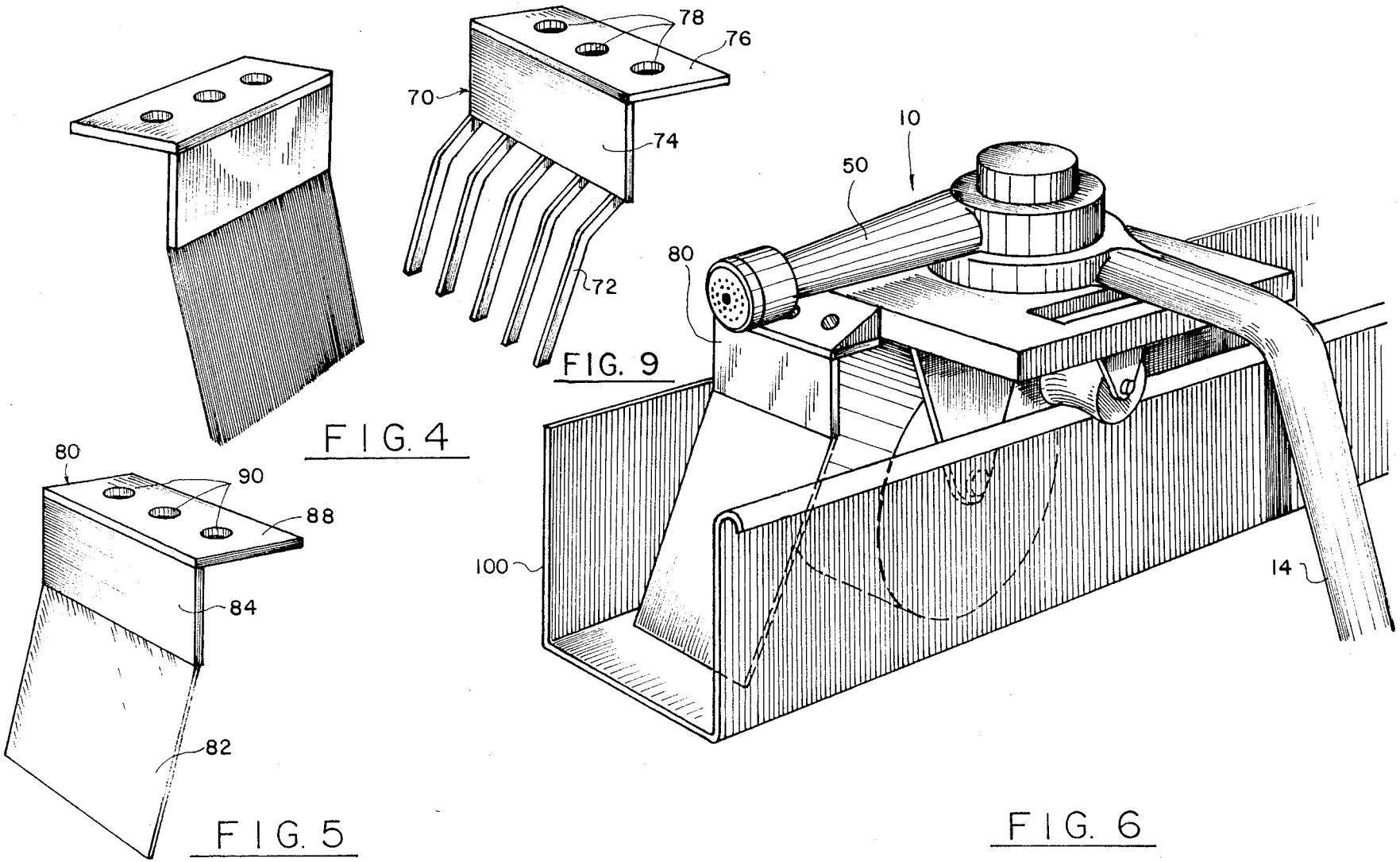
FIG. 4 is a perspective view of a cleaning attachment tool for use in the apparatus of the present invention.
FIG. 5 is a perspective view of another cleaning attachment tool.
FIG. 6 is a perspective view of the cleaning attachment tool of FIG. 5 in use on the apparatus of the present invention.
FIG. 9 is a perspective view of a broom-type cleaning attachment tool.

In order to perform various cleaning operations, a number of cleaning attachments can be used for collecting debris in the gutter 100. The various attachments are illustrated in FIGS. 4 and 9. For example, the attachment illustrated in FIG. 9 is a raking attachment which has a number of elongated teeth-like members 72 fixedly attached at an angle to a plate 74. The teeth 72 are spaced apart similar to a rake, allowing collection of leaves and other light debris within the gutter 100. Fixedly attached to a free side of the plate 74 is a securing plate 76 which has three openings therethrough. The openings 78 are spaced in a manner similar to the spacing of openings 30 of the securing plate 22 and 24. By passing a bolt or a pin through the corresponding openings 78 and 30, the raking attachment tool can be secured in a fixed relationship to the remainder of the apparatus 10. As will be appreciated, the attachment 70 can be alternatively secured to either securing plate 22 or 24, depending on the direction of movement of the apparatus 10 along the gutter 100. Another attachment 80 is illustrated in FIG. 5, wherein the raking teeth 72 are substituted by rubber sheets 82 which extend downwardly from a common plate 84, to which they are fixedly attached. The plate 84 is, in turn, secured along one of its edges to an intermediate plate 86, similar to the plate 74 of the attachment tool 70. A securing plate 88 is attached to a free side of the plate 86, with a securing plate 88 being provided with three openings 90, which correspond to the openings 30 of the securing plates 22 or 24. By inserting the bolt (not shown) or a pin through the openings 90 and 30, the attachment tool 80 can be easily secured to the remainder of the cleaning apparatus 10.

Illustrated in FIG. 4 is an attachment which resembles a broom with a plurality of bristles for cleaning the gutter 100.

In operation, the apparatus 10 is assembled by selecting a desired attachment tool 70 or 80, or other suitable attachment for performing a certain cleaning job on the gutters 100. The handle 14 is then extended by threadably connecting sections of the handle means 14 or by telescopically extending handle 14 to the desired length. The apparatus 10 is elevated and positioned above the gutter, so that the wheel 40 rolls along the bottom of the gutter 100, while the roller 48 engages a top the surface of the lip 102 of the gutter 100. The leaves are removed from the gutter 100 and, subsequently, water is delivered from a water supply through the handle means 14 to the nozzle means 50 for spraying the bottom of the gutter 100 and cleaning the dust accumulated within the gutter. If desired, a rubber attachment 80 can be used to squeeze out water from the gutter 100, leaving a relatively moisture free surface. If so desired, a sealant, or other preventive solution, can be delivered through the handle 14 and deposited as a coating layer on the bottom of the gutter 100, by spraying the surface of the gutter through the nozzle spraying head 56.

Many changes and modifications can be made in the design of the apparatus of the present invention without departing from the spirit thereof. I therefore pray that my rights to the present invention be limited only by the scope of the appended claims.

I claim:

1. A roof gutter cleaning apparatus, comprising:

an elongated handle means;

a supporting plate means fixedly attached to one end of said elongated handle means, said supporting plate means having a top surface and a bottom surface;

a first supporting bracket means fixedly attached to the bottom surface of the supporting plate means and extending perpendicularly downwardly therefrom;

a first roller means rotationally supported by said first bracket means, said first roller means being adapted for supporting said cleaning apparatus while rolling along a bottom surface of a roof gutter;

a second supporting bracket means fixedly attached to the bottom surface of the supporting plate means, laterally spaced from said first bracket means and extending perpendicularly downwardly from the bottom surface of the supporting plate means; and a second roller means rotationally supported by said second bracket means and adapted for stabilizing said cleaning apparatus while rolling along a top surface of a roof gutter lip.

2. The apparatus of claim 1, wherein an axis of rotation of the first roller means and an axis of rotation of the second roller means are in a vertically spaced relationship to each other.

3. The apparatus of claim 1, further comprising a nozzle means mounted for a limited pivotal movement on the supporting plate means and adapted for delivering of a treatment liquid to said roof gutter, upon demand.

4. The apparatus of claim 1, further comprising securing plate means for securing a cleaning attachment on opposite sides of said supporting plate means.

5. The apparatus of claim 3, wherein said handle means is provided with an internal conduit for transporting the treatment liquid from a source below the roof gutter to the nozzle means.

6. The apparatus of claim 5, further comprising a means for propelling the treatment liquid along the internal conduit of said handle means.

7. The apparatus of claim 6, wherein said propelling means comprises a propeller securedly mounted within said handle means, and provided with a connecting means adapted to engage with a torque applying means.

8. The apparatus of claim 2, wherein said first supporting bracket means comprises a first pair of spaced-apart parallel brackets supporting said first roller means by a pin passing through co-aligned apertures formed in lower portions of the first pair of brackets.

9. The apparatus of claim 8, wherein said second supporting bracket means comprises a second pair of spaced-apart parallel brackets supporting said second roller means by a pin passing through co-aligned apertures formed in lower portions of the second pair of brackets.

10. A roof gutter cleaning apparatus, comprising:

an elongated hollow handle;

a generally rectangular supporting plate fixedly attached to one end of said elongated handle, said supporting plate having a top surface and a bottom surface;

a first pair of supporting brackets extending perpendicularly downwardly from the bottom surface of the supporting plate;

a first roller rotationally mounted and supported between said first brackets for rolling along a bottom surface of a roof gutter;

a second pair of supporting brackets fixedly attached to the bottom surface of the supporting plate, the second pair of brackets being laterally spaced from the first pair of brackets and extending in parallel relationship to the first pair of brackets;

a second roller rotationally supported by the second pair of brackets for stabilizing movement of the cleaning apparatus while rolling along a roof gutter lip;

a nozzle means mounted in fluid communication with the internal conduit formed by the hollow handle means, the nozzle means being adapted for delivery of a cleaning or treatment liquid to the roof gutter, said nozzle means being mounted for a limited pivotal movement on said supporting plate, such that direction of a liquid outlet of said nozzle means can be alternatively changed by rotating the nozzle means by 180 degrees;

a pair of securing plates extending on opposite sides of the supporting plate at an angle to the supporting plate and adapted for securing of a roof gutter cleaning attachment to the supporting plate; and a means for propelling the treatment liquid along the internal conduit of the handle from a source of the liquid to the nozzle means.

11. The apparatus of claim 10, wherein said propelling means comprises:

a propeller securedly mounted inside the internal conduit of the handle means and means for attaching a torque applying means for rotating the propeller.

* * * * *